US006691364B1

(12) United States Patent
Truan et al.

(10) Patent No.: US 6,691,364 B1
(45) **Date of Patent: *Feb. 17, 2004**

(54) EXTRUDED VEHICLE MOUNTED BROOM

(75) Inventors: Charles J. Truan, Royal Oak, MI (US); James Truan, Berkley, MI (US); Joshua Scott, Royal Oak, MI (US); Paul Mandrik, Harrison Township, MI (US)

(73) Assignee: Trynex, Inc., Warren, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/347,819

(22) Filed: Jan. 21, 2003

Related U.S. Application Data

(63) Continuation of application No. 09/637,340, filed on Aug. 11, 2000, now Pat. No. 6,536,067.

(60) Provisional application No. 60/181,246, filed on Feb. 9, 2000, and provisional application No. 60/148,617, filed on Aug. 12, 1999.

(51) Int. Cl.[7] ..... E01H 1/04

(52) U.S. Cl. ..... 15/78; 15/79.2; 15/202

(58) Field of Search ..... 15/78, 79.1, 79.2, 15/183, 202

(56) References Cited

U.S. PATENT DOCUMENTS

| | | | | |
|---|---|---|---|---|
| 5,621,940 | A | * | 4/1997 | Lewis |
| 6,076,221 | A | * | 6/2000 | Bradshaw |
| 6,088,865 | A | * | 7/2000 | Truan |

FOREIGN PATENT DOCUMENTS

| | | | |
|---|---|---|---|
| DE | 2039761 | * | 2/1972 |
| GB | 987730 | * | 3/1965 |

* cited by examiner

*Primary Examiner*—Randall E. Chin
(74) *Attorney, Agent, or Firm*—Howard & Howard

(57) ABSTRACT

A vehicle mounted broom that has a modular construction, improved sweeping action and versatile mounting capabilities. The broom has brush strips and integral channels formed in a bottom side of the housings that reduce greatly or eliminate rocking of the brush strips with respect to the housing to which they are removably mounted. The main housing is extruded from aluminum.

11 Claims, 4 Drawing Sheets

EXTRUDED VEHICLE MOUNTED BROOM

CROSS-REFERENCE TO RELATED APPLICATIONS

This application is a continuation of U.S. patent application Ser. No. 09/637,340, filed Aug. 11, 2000, now U.S. Pat. No. 6,536,067. This application claims priority to U.S. Provisional applications, Ser. No. 60/148,617 filed Aug. 12, 1999 and Ser. No. 60/181,246 filed Feb. 9, 2000.

FIELD OF THE INVENTION

The present invention generally relates to vehicle mounted brooms and more particularly to fixed vehicle mounted brooms. Fixed vehicle mounted brooms typically have a rectangular housing that receives a plurality of brushes that are mounted in tracks in the housing. The brushes of the broom are mounted so that they can be easily replaced as the brushes wear. The housing generally includes a mounting assembly to allow the broom to be mounted to a vehicle, such as for example to the snow plow attachment on a pick-up truck. The pick-up truck can then be used to push or pull the broom to sweep an area.

BACKGROUND

Vehicle mounted brooms are well known. A common type of vehicle mounted broom is a rotary broom. Rotary brooms are mounted on specially designed vehicles for sweeping only. The broom is typically a circular disk with bristles mounted to the disk in a circular pattern. The broom is spun at high RPM on a drive axis to sweep in a circular manner. Because of the spinning action of the broom, there is considerable dust when sweeping. To reduce the dust, some of these vehicles have vacuum systems that vacuum while sweeping is being done.

Rotary brooms are very expensive, they include the broom, the drive mechanism and the vehicle and the vehicle can only be used for sweeping. The entire purchase price is attributed to the sweeping function because of the single vehicle use. In addition to being expensive, the rotary brooms require fairly high maintenance, particularly when compared to fixed vehicle mounted brooms. They also have a problem with excessive dust, which limits their use to applications where large amounts of airborne dust particles are not a problem. They are also of no value in sweeping larger objects, such as chunks of wood, metal parts, etc.

Another type of rotary broom is the drum type broom. This broom is shaped like a drum and has bristles mounted about the periphery of the drum. The broom is mounted for rotation about an axis that extends generally parallel to the longitudinal centerline of the drum. The drum type rotary broom suffers from the same disadvantages as the disc type rotary broom.

Fixed vehicle mounted brooms have no moving parts. They are typically made up of several rows of bristles, which are mounted, to the underside of a housing, which is then mounted to a vehicle, such as for example a pickup truck. By way of example, with pickup trucks, the brooms can be mounted to the vehicles snowplow mounting assembly and raised and lowered for use. When compared to rotary brooms, fixed vehicle mounted brooms are very inexpensive and require minimal maintenance. The only maintenance that is required is bristle replacement.

In the vehicle-mounted broom disclosed in U.S. Pat. No. 5,621,940, the brushes are loosely mounted within generally C-shaped tracks. The bristles of the brushes are mounted within an elongated holder 5 that is received within each of the respective tracks 4. The holder has a head which is slightly larger than the opening in the track to prevent it from falling out of the track, but is smaller than the interior of the track to allow easy insertion, removal and a rocking action. The C-shaped tracks are mounted to the bottom of the housing 1 by spot welding the tracks to the metal housing 1. An angle bracket 2 is also used to hold the bristles in the tracks after they have been inserted.

Although the fixed vehicle mounted broom of U.S. Pat. No. 5,621,940 has advantages over rotary brooms; it still has several disadvantages. One of the main problems is that the loosely fitted bristles reduce the effectiveness of the brooms sweeping capabilities. The bristles ability to rock in their tracks allows dirt, objects to be swept, water, etc. to be swept over and missed by the broom. A further problem is the positioning of the bristles closely adjacent the housing edges. There is no dust collection and retention zone due to the position of the bristles with respect to the housing edge. An additional problem is the limited versatility of the mounting assemblies. The mounting assemblies of the known vehicle mounted brooms do not allow the broom to be easily and quickly mounted to different types of vehicles. Weight is also a problem in many applications. Steel brooms are heavy and are difficult to handle. The heavier brooms are also difficult to ship. Finally, the known vehicle mounting brooms include complex attachment tracks that receive the brushes. These attachment tracks are mounted to a broom frame by bolts or welds. It would be advantageous to design an assembly for mounting the brushes that was less complex and have fewer parts.

SUMMARY OF THE INVENTION

The present invention overcomes the problems found in known rotary and fixed vehicle mounted brooms. The broom of the present invention has a main body with multi-purpose mounting brackets connected to a top side of the main body for mounting the broom to various vehicles. Integral channels are formed in the bottom side of the main body for receiving a first set of brush strips. The integral channels extend generally parallel to one another and longitudinally along the length of the bottom side of the main body. Each end of the bottom side of the main body includes a pair of openings. Each of these pairs of openings is adapted to receive a male member of an end cap.

The elongated brush strips include a head portion and a body portion with a plurality of bristles extending from the body portion. The bristles of the preferred embodiment are single member bristles mounted adjacent to one another along the length of the brush strip. The head portion of a brush strip is shaped to allow the brush strip to be mounted within the integral channels of the main frame. Each integral channel includes flanges that engage the head portion to retain the head portion within the respective channel.

Each of the integral channels has a longitudinal centerline and the brush strips are mounted within the channels so that the brush strips do not pivot more than 5° about the longitudinal centerline but are still easily removed and replaced by sliding them into and out of the channel. In the preferred embodiment the body portion of the brush strip includes a recess to receive the bristles and the head portion is configured to fit snugly into the channel to lock the brush strip into the channel to prevent the brush strip from rocking within the channel and to maintain the brush strips in a relatively fixed relationship to one another. In this way, the brush strips act like separate fixed walls or curtains to scrape the surface being swept. In the event the bristles bend and allow debris to pass to the next brush strip, that next brush strip acts as a wall, and so on through each row of brush strips.

Mounting brackets of various kinds can be mounted to the top of the broom for mounting the broom to different vehicles or vehicle mounts. In the preferred embodiment, the top of the broom has two sets of four internally threaded openings. The openings receive bolts to attach the various mounting brackets to the broom housing. A set of pockets is used for receipt of the tines of a forklift. Tangs are mounted to the housing for the receipt of the edge of a bucket. A further mounting assembly receives a three point hitch assembly.

DETAILED DESCRIPTION OF THE INVENTION

Figure 1:
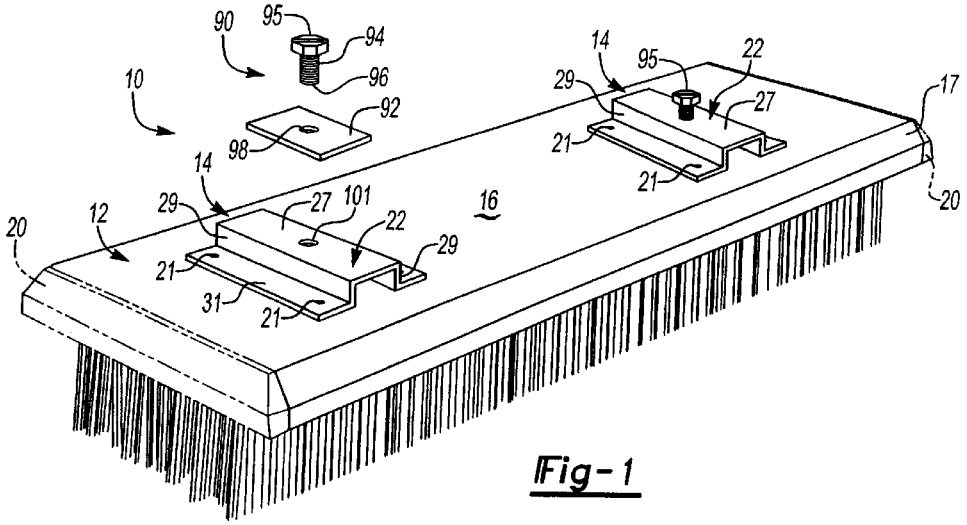
FIG. 1 is a perspective view of the vehicle-mounted broom of the present invention having mounting brackets for mounting to the tines of a vehicle.
Figure 7:
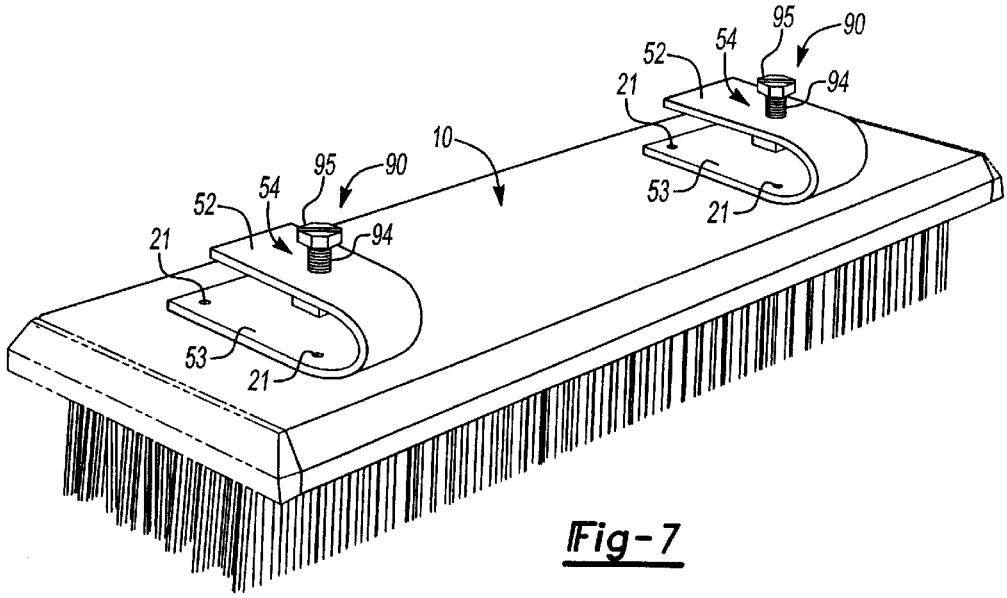
FIG. 7 is a perspective view of the vehicle-mounted broom having mounting brackets for mounting the broom to a bucket.
Figure 8:
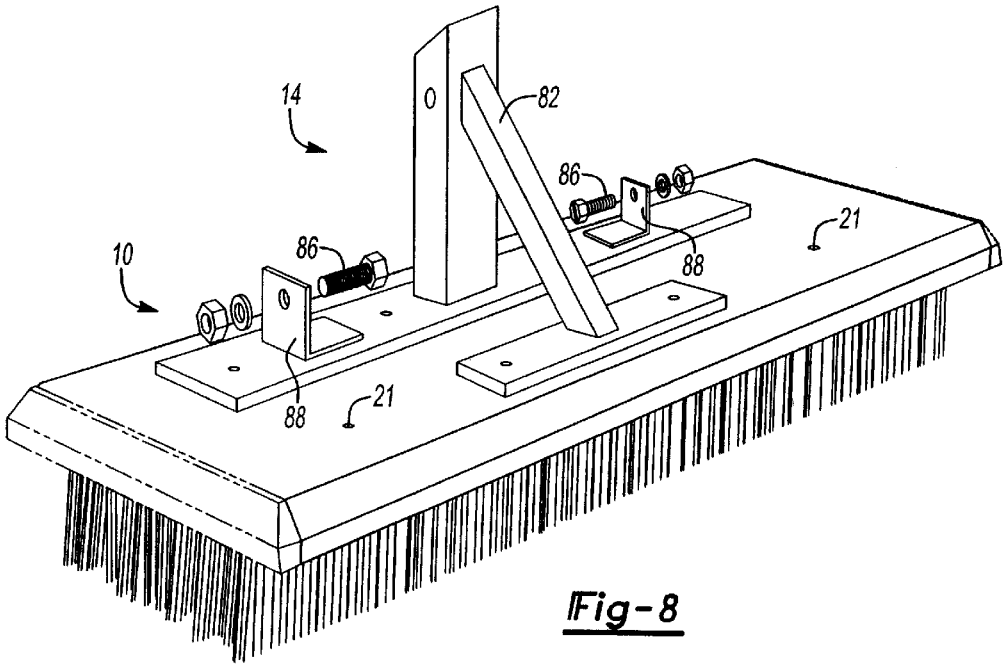
FIG. 8 is a perspective view of the vehicle-mounted broom having mounting brackets for mounting the broom to a three-point hitch.

The present invention relates to a vehicle-mounted broom shown generally at 10. The broom 10 has a main body 12. A mounting assembly shown generally at 14 is attached to topside 16 of the main body 12. The mounting assembly 14, as shown in FIG. 1, can be of the type that accepts the tines of a forklift. The mounting assembly 14 can also be used to mount the bucket of a loader, such as a front loader as shown in FIG. 7. Also as shown in FIG. 8, the vehicle mounted broom 10 can be mounted to a three point hitch through use of the mounting assembly 14. Mounting assembly 14 permits the broom 10 to be quickly and easily mounted to the front of a standard pick-up truck having a three point hitch assembly. Overall, the broom 10 is extremely versatile and can be mounted, depending upon the mounting assembly used, to various types of vehicles. In the preferred embodiment, the broom 10 has two sets of four internally threaded openings 21 that are adapted to receive bolts for mounting one of the various mounting assemblies 14.

The main body 12 is shown in FIG. 1 with an endcap 20 in place. The endcap 20 includes male members that are received in grooves 23 formed in a bottom side 25 of the main body 12 to secure the endcap 20 to the main body. With reference to FIG. 1, the mounting assembly for mounting tines of a forklift is shown generally at 14. The mounting assembly 14 includes a channel 22 for receipt of the tine of a forklift. The channels 22 include the top 27, sides 29 and mounting flanges 31. The mounting flanges have openings, which correspond to the openings 21 in the body 12 for receipt of bolts to secure the channels 22 to the body 12. In use, the tines of a forklift truck are easily received within the channels 22 so that the broom can be connected, raised and lowered with respect to the forklift truck.

Figure 2:
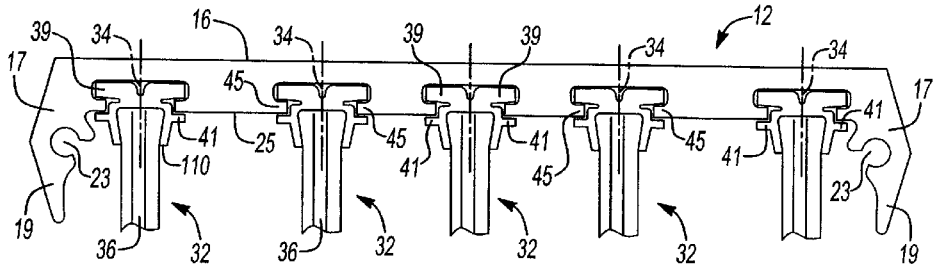
FIG. 2 is an end view of the main housing with an end cap removed illustrating the brush strip attachment and the grooves for connecting an end cap to the main housing.

As shown in FIG. 2, the main body 12 is a single unitary piece that has the bottom side 25, the top side 16, and sides 17 which include skirts 19. The bottom side 25 includes integral channels 34 that are formed in the bottom side 25 and integral with the main body 12. Each integral channel 34 includes a pair of flanges 45. Adjacent the ends of the main body 12 is a groove or opening 23 formed integral with the bottom side 25. Openings 23 receive the male members of endcaps 20. Main body 12 is formed by an extrusion of aluminum. By forming the body 12 from a single extruded piece of aluminum, the strength of the body 12 is increased and the construction is simplified.

The extrusion includes side 17 which in the preferred embodiment are integral to main body 12. The extruding process forms the main body 12, side 17, channels 34 and openings 23 in a long continuous extrusion. As will be appreciated, the desired length can then be cut from the continuous extrusion. This greatly simplifies the manufacture of the broom 10 while the use of aluminum greatly reduces weight. In the preferred embodiment, the main body 12 is about 48 inches long, 8.5 inches wide and 1.625 inches thick including the skirt 19. The channels 34 are about 0.925 inches wide at the widest point and 0.675 inches at the narrowest. The preferred aluminum is 6063 alloy and T5 temper.

Brush strips 32 are mounted to the bottom side 25 of the main body 12. The brush strips 32 of the broom 10 are formed in elongated strips, which are received within the integral channels 34 formed on the bottom side 25 of the body 12. In the preferred embodiment, the brush strips 32 are defined by a plurality of single bristles 36 mounted adjacent to one another and extending from the channels 34. Said another way, the brush strips 32 in the preferred embodiment are constructed of a plurality of single bristles 36, not double or triple strands folded to form the separate bristles. Each of the brush strips 32 are slid into a corresponding integral channel 34 to form a series of spaced brushes for sweeping. Preferably, the brush strips 32 are snugly received within the channels 34 so that they do not rock, but can be removed to allow replacement.

Figure 3:
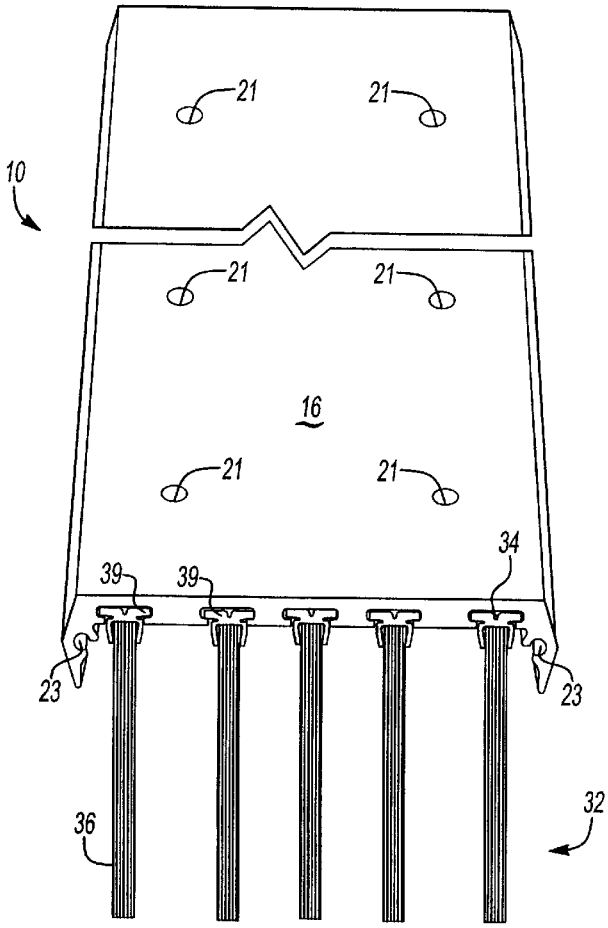
FIG. 3 is a partial perspective view of the main housing and a brush strip.
Figure 4:
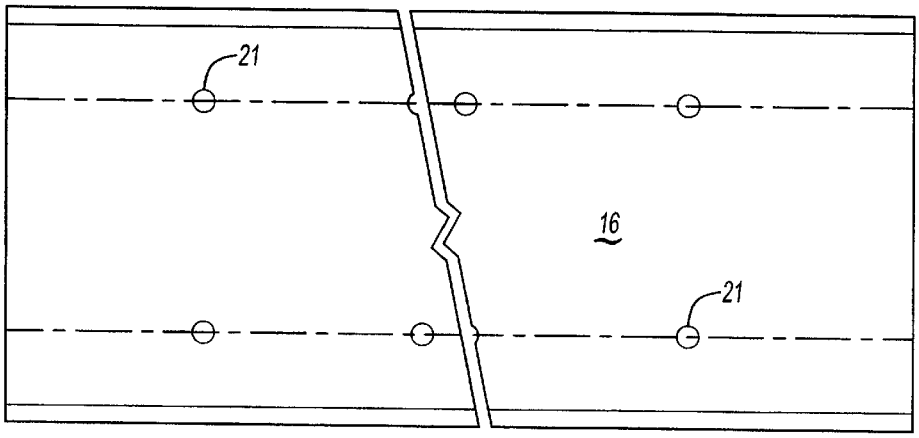
FIG. 4 is a top view of the housing.
Figure 5:
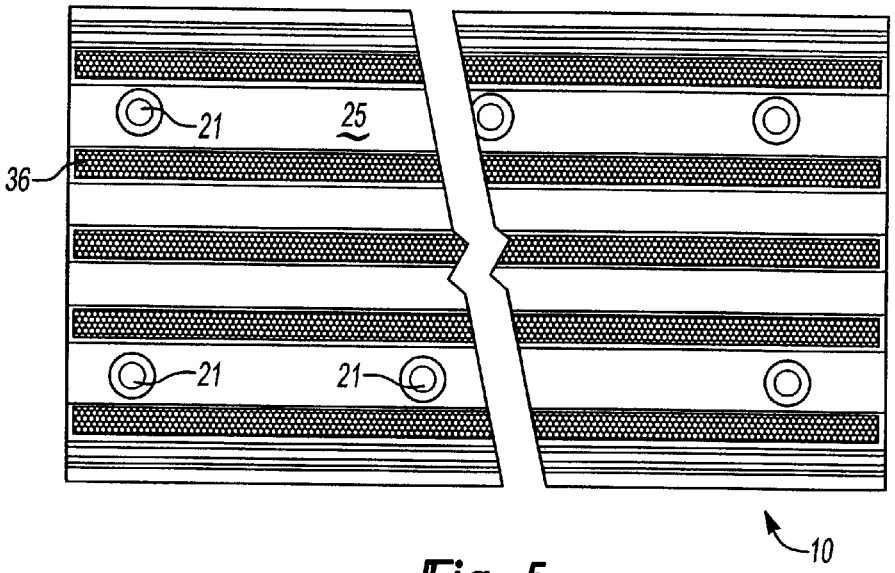
FIG. 5 is a bottom view of the vehicle-mounted broom.
Figure 6:
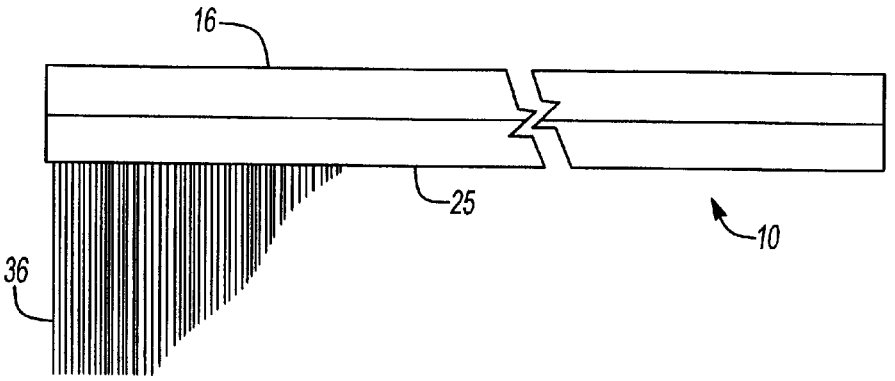
FIG. 6 is a partial front view of the vehicle-mounted broom illustrating a row of bristles.

As illustrated in FIG. 2, the brush strips 32 have a head portion 39. In the preferred embodiment, the head portion 39 has C-shaped sides 41 which receive flanges 45 to reduce or eliminate bristle rocking. The bristles 36 are secured in a recess 110 in the head portion 39 by glue, welding or other readily available and known techniques. As can be seen in FIG. 2, the flanges 45 extending across the opening formed in the integral channel 34 to partially close the channel opening. The interaction between the sides 41 and the flanges 45 prevent the brush strips 32 from rocking more than about 5° with respect to the integral channel 34 and the body 12. In FIG. 3, an alternative head portion 39 is illustrated.

The brush strips 32 are relatively fixed with respect to the integral channels 34 and have only slight movement with respect to the integral channel 34 if any movement at all. This locking of the brush strips 32 with respect to the broom 10 provides a far superior sweeping broom because the brush strips 32 act as a series of spaced walls or squeegees that engage and push debris along the sweeping path. Debris that pass through the first row of brush strips 32 are caught by the second row and debris that pass the second row are caught by the third row etc. The sweeping capabilities of the broom 10 of the present invention are so good that the broom 10 can be effectively used to move water as well as debris. But, as should be appreciated, the brush strips 32 can still be easily removed by sliding them from the channels 34. They are held to prevent rocking, but still slide for replacement purposes.

With reference to FIG. 7, two spaced tangs 54 permit a bucket to be inserted under the tangs 54 for attaching the broom 10 to the bucket of a vehicle. In the preferred embodiment, the bucket would be inserted under a top 52 of the C-shaped tang 54 over a bottom portion 53. To secure the broom 10 to the bucket, the broom 10 can then be chained to the bucket. In the preferred embodiment, a novel pad connector 90 is used for connecting the broom 10 and the bucket. In the preferred embodiment, the tangs 54 are generally C-shaped with one side of the C having preferably four (4) or less holes for receipt of bolts that are then threaded into openings 21. The pad connector 90 is shown in exploded view in FIG. 1 and installed in FIGS. 1 and 7. The connector 90 has a pad 92 which receives a bolt 94 having a swivel or rounded end 96 for receipt in opening 98 of pad 92. The pad 92 engages either the tine or bucket and by turning bolt 94, through knob 95, the pad 92 engages and traps the tine or bucket. The end 96 allows the bolt 94 to be threaded into opening 101 without the pad 92 rotating. The opening 101 is internally threaded to receive bolt 94.

With reference to FIG. 8, a mounting assembly 14 to accommodate a snowplow hitch assembly is illustrated. The assembly 14 has a mount 82 that attaches to the top of the broom 10. Preferably, the mount 82 is attached with bolts to the internally threaded openings 21. Lift arm pins 86 are mounted to the end of the mount 82 to brackets 88. This assembly allows easy attachment of the broom 10 to the snowplow hitch of a vehicle such as for example a pick-up truck after the snowplow blade has been removed. As will be appreciated, the broom can then be moved in the same manner as the snowplow blade.

It will be appreciated that the above description relates to the disclosed embodiment by way of example only. Many apparent variations of the disclosed invention will be known to those of skill in this area and are considered to be within the scope of this invention and are considered to be within the scope of the following claims.

What is claimed is:

1. A vehicle mounted broom comprising:

a main body formed of aluminum in a single, continuous extrusion having a top side, a bottom side, and longitudinal and lateral sides;

mounting fixtures supported by said top side to enable said main body to be mounted to a vehicle;

said bottom side defining longitudinally extending channels having a depth which is less than the width of said longitudinal and lateral sides and having at least one end open for receipt of a brush strip;

said channels being formed continuously with said main body as a unitary piece and being generally T-shaped defining a cavity with an opening which is narrower than said cavity to retain said brush strip within said channels.

2. The vehicle mounted broom of claim 1, wherein said main body includes a longitudinal extending skirt extending from said main body to a distance beyond said bottom side to define at least one of said longitudinal sides.

3. The vehicle mounted broom of claim 2, wherein said main body includes a pair of longitudinally extending skirts defining both of said longitudinal sides.

4. The vehicle mounted broom of claim 3, wherein said skirt is formed continuously with said main body in a unitary piece.

5. The vehicle mounted broom of claim 2, wherein said skirt is formed continuously with said main body in a unitary piece.

6. The vehicle mounted broom of claim 1, wherein both of said longitudinal sides extend below said bottom side to define said skirts.

7. The vehicle mounted broom of claim 1, further including end caps mounted to said lateral sides.

8. The vehicle mounted broom of claim 7, wherein at least one of said longitudinal and said lateral sides include apertures and said end caps include male members for insertion into said apertures to removably secure said end caps to said main body.

9. The vehicle mounted broom of claim 1, wherein said brush strips are removably mounted within said channels.

10. The vehicle mounted broom of claim 1, wherein each of said brush strips include a head portion configured to fit snugly within respective channels to reduce rocking, but allow removal of said brush strip from said channels.

11. The vehicle mounted broom of claim 1, including a connector pad movably mounted to said main body, said connector pad having a pad adapted to engage the mounting fixture, and a threaded bolt engaging said pad to move said pad relative to said main body.

* * * * *